US005455563A

United States Patent [19]

Davies et al.

[11] Patent Number: 5,455,563

[45] Date of Patent: Oct. 3, 1995

[54] MAGNETIC MARKER AND METHOD FOR MODIFYING THE MAGNETIC PROPERTIES THEREOF

[75] Inventors: Dafydd G. Davies, Cambridge; Stephen H. Chambers, Willingham, both of United Kingdom

[73] Assignee: Esselte Meto International Produktions GmbH, Germany

[21] Appl. No.: 853,692

[22] PCT Filed: Oct. 14, 1991

[86] PCT No.: PCT/GB91/01783

§ 371 Date: Jun. 5, 1992

§ 102(e) Date: Jun. 5, 1992

[87] PCT Pub. No.: WO92/07343

PCT Pub. Date: Apr. 30, 1992

[30] Foreign Application Priority Data

Oct. 15, 1990 [GB] United Kingdom ..... 9022318

[51] Int. Cl.[6] ..... G08B 13/24

[52] U.S. Cl. ..... 340/551; 340/572

[58] Field of Search ..... 340/572, 551

[56] References Cited

U.S. PATENT DOCUMENTS

| | | | |
|---|---|---|---|
| 4,484,184 | 11/1984 | Gregor et al. | 340/572 |
| 4,682,154 | 7/1987 | Fearon et al. | 340/572 |
| 4,710,754 | 12/1987 | Montean | 340/572 |
| 4,829,288 | 5/1989 | Eisenbeis | 340/551 |
| 4,857,891 | 8/1989 | Heltemes | 340/551 |
| 4,884,063 | 11/1989 | Church et al. | 340/572 |
| 4,940,966 | 7/1990 | Pettigrew et al. | 340/551 |
| 4,960,651 | 10/1990 | Pettigrew et al. | 428/607 |
| 4,967,185 | 10/1990 | Montean | 340/572 |

FOREIGN PATENT DOCUMENTS

| | | |
|---|---|---|
| 8316488 | 2/1984 | Australia . |
| 0295085 | 12/1988 | European Pat. Off. . |
| 1253115 | 11/1971 | United Kingdom . |

*Primary Examiner*—John K. Peng
*Assistant Examiner*—Thomas J. Mullen, Jr.
*Attorney, Agent, or Firm*—Sixbey, Friedman, Leedom & Ferguson

[57] ABSTRACT

A method of modifying the magnetic properties of a thin film of a magnetically active material is provided which comprises forming surface modulations on the material in order to partition it into regions which display at least some degree of mutual magnetic independence. The resulting modified thin film may be used as a marker or tag in an anti-pilferage or article location system. The surface modulations formed on the material in the anti-pilferage or article location marker serve to enhance the response of the marker when used in an anti-pilferage or article location system.

20 Claims, 4 Drawing Sheets

MAGNETIC MARKER AND METHOD FOR MODIFYING THE MAGNETIC PROPERTIES THEREOF

BACKGROUND OF THE INVENTION

This invention relates to the modification of the magnetic properties of materials, and in particular in respect to the performance of high-permeability magnetic materials used in anti-pilferage or article location systems.

Certain types of markers used in anti-pilferage systems or article location systems rely for their detection and recognition on the magnetic response of a component or components of the marker to an applied varying magnetic field. Desirable magnetic properties include high but well-defined magnetic permeability, low hysteresis, and well-defined response non-linearities such as are found at the approach to magnetic saturation. It is known that the physical dimensions and shapes of the magnetic components are important in determining their response and performance in the systems. The present invention is concerned with the modification and in particular the improvement of the performance of these components by surface modulations added during manufacture within the component, perhaps in conditions where it is not possible of desirable to change the main shape or dimensions of the component.

SUMMARY OF THE INVENTION

Examples of these components include strips, sheets or thin films of high-permeability amorphous, crystalline or mixed-phase magnetic material, such as strips of melt-spun amorphous magnetic alloy or thin films of magnetic alloy deposited upon a substrate.

According to one aspect of the present invention, there is provided a method of modifying the magnetic properties of a thin film of a magnetically active material, which comprises forming surface modulations on said material in order to partition the material into regions which display at least some degree of mutual magnetic independence.

According to a second aspect of the present invention, there is provided a marker or tag for use in an anti-pilferage or article location system, which marker includes a thin film of a magnetically active material supported on a substrate, characterised in that said magnetically active material has formed on it surface modulations which partition said material into regions which display at least some degree of mutual magnetic independence.

Generally, the magnetically active material will be a high-permeability, low-coercivity material and will be supported on a substrate.

The surface modulations are advantageously formed by a technique involving the removal of material from the film; the technique may involve the application of a blade or sharpened point to the surface of said material, or removal of material by chemical means. Preferred techniques include cutting, scribing, perforation and scratching. Advantageously, less than 25% of the magnetically active material is removed. In most embodiments, less than 5% of the magnetically active material is removed, and in the currently preferred embodiments between 0.1% and 1% is removed.

Alternatively, the surface modulations may be formed by a technique which does not remove material from the thin film, for example by a technique which is such as to cause localised plastic deformation of the magnetically active material. Examples of suitable techniques are stamping, cracking or folding the thin film. The surface modulations may also be formed by means of impregnation or localised heating. This can be achieved by means of focused electromagnetic radiation, laser radiation, ion beams, beams of neutral particles, jets of solid particles or jets of liquids.

In other embodiments, the surface modulations are formed by means of localised application of further quantities of the same magnetically active material or of a different magnetically active material.

The surface modulations are preferably such as to change the effective magnetic permeability of the material with little effect on its total saturation magnetisation. They also advantageously reduce the coercive force for high-frequency excitation of the magnetically active material.

In summary, techniques of use in the present invention include cutting (fully or partially), perforating, scratching, scribing, stamping and etching; physical and chemical processes such as reaction, impregnation and localised heating; and localised application of further quantities of the same material or of a magnetically different material. We have found that ablation, impregnation or heating processes can be carried out by beams of focused electromagnetic radiation, laser radiation, ion beams, beams of neutral particles or by Jets of solid particles or liquids.

According to a preferred feature of this invention, these modifications are not carried out over the whole of the surface or volume of the magnetic component, but in localised areas, which may be, for example, well-defined or irregular lines or patterns. Only very small modifications are required such that there is no need for expensive masking or etching procedures. For example, a disruption of the surface which results in the removal of as little as 0.5% of the material can lead to the desired effect. The purpose of these modifications is to divide the component into portions which behave, to a greater or lesser extent, magnetically independently of one another. This causes the component to act in a manner more similar to a collection of smaller, advantageously-dimensioned pieces than to a single non-optimally shaped piece. An alternative interpretation is that the modifications affect the magnetic flux distribution within and around the component in a way which changes (usually reduces) the effective magnetic permeability of the component with little effect on the total saturation magnetisation. The resulting permeability can be advantageously chosen to provide optimal detectability and/or discrimination of the magnetic marker within the system, by controlling the distribution, pattern or spacing of the surface or volume modulations or modifications.

We have also found that the coercive force (hysteresis) for high-frequency excitation can be significantly reduced by these modification processes. For example, a piece of thin film amorphous metal glass of the type described in U.S. Pat. No. 4,960,651 and having a thickness of 1 μm and sides 100 mm×100 mm initially had a coercive force of 100 A/m; but when it had been scratched with a set of blades separated by 10 mm the coercive force fell to less than 20 A/m. As a result of this process, the material gave four times as much signal in an anti-pilferage system than before modification, leading to a very strong enhancement of detection of the anti-pilferage tag in the system.

The localised modifications can be carried out simply and cheaply in the manufacture of the components. The components (e.g. magnetic markers) are often manufactured by using continuous large rolls, strips or sheets of material which are subsequently divided into individual components.

Modulation methods which are particularly suited to simple manufacture include perforating, scratching, scribing or stamping of the magnetic material or of laminated components including the magnetic material.

We have found the invention valuable in order to modify components or markers which were manufactured longer or wider in some dimension than is optimal for detection in a given system. For example, long strips of metal can be stamped, heated, perforated or scratched at intervals along their length. The invention is easily applied to thin film markers, where the magnetic material can be scratched using for example abrasive tips, needles or fixed or rotating blades. Alternatively, the process of forming marker perforations, or security cuts in the marker, can be used to optimise the marker signal according to the invention by choosing the spacing and disposition of the security cuts which perforate or deform the magnetic material.

The spacing is chosen with reference to relevant magnetic characteristics such as permeability and coercivity and their effect on the detected signal. Typically, a spacing of a few millimeters optimises the signal derived from material of a thickness of about 1 micron.

We have also found that the present invention permits thinner markers or marker films than hitherto was possible to be used to give detectable markers. This is because the detection of the markers is usually dependent on the aspect ratios of length and width to thickness of the magnetic material, and with fixed lengths and widths the thickness of the magnetic component needs to be held above a certain value on manufacture to produce acceptable performance in the detection system. Since the invention essentially leads to an assembly of shorter components, thinner markers can be used according to the invention while still giving acceptable performance. This leads to cost savings for the magnetic material which is often produced by an expensive deposition process.

BRIEF DESCRIPTION OF THE SEVERAL FIGURES

DETAILED DESCRIPTION OF THE PREFERRED EMBODIMENT

Figure 1:
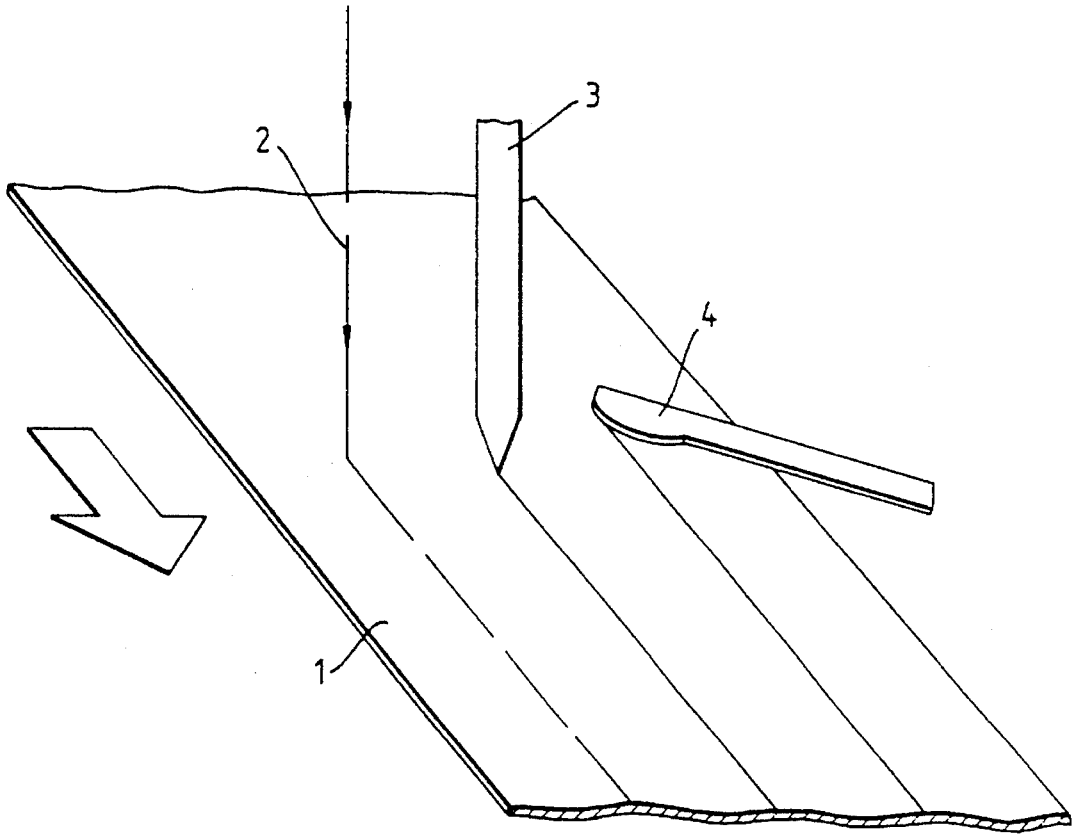
FIG. 1 is a schematic, perspective view of the magnetic film having surface modulations formed on its upper surface in conformance with the method of the invention.

An example of the modification process envisaged by this invention is shown in FIG. 1, where the magnetic film (1) (bonded to a suitable carrier medium) in the form of a sheet or roll moving in the direction indicated is modified by a particle or liquid beam or focused beam of radiation (2) which may be continuous or intermittent. Alternatively, a sharp or heated tip, (3), or scratching or cutting blade, (4), may be used.

By way of illustration, a specific example of implementation of this invention will now be given with reference to the drawings.

EXAMPLE

The magnetic medium to be processed is an amorphous metal film of the type described in U.S. Pat. No. 4,960,651 of thickness about 1 micron and width 1 m, supported on a polymer roll of thickness about 20 microns and in lengths of several hundred meters. The material is modified with many longitudinal continuous scratches of spacing about 10 mm, each scratch having a width of less than 50 microns. The process is shown schematically in FIG. 2. The scratching is achieved with an array of over 100 sharp blades pressed into contact with the film.

Figure 2:
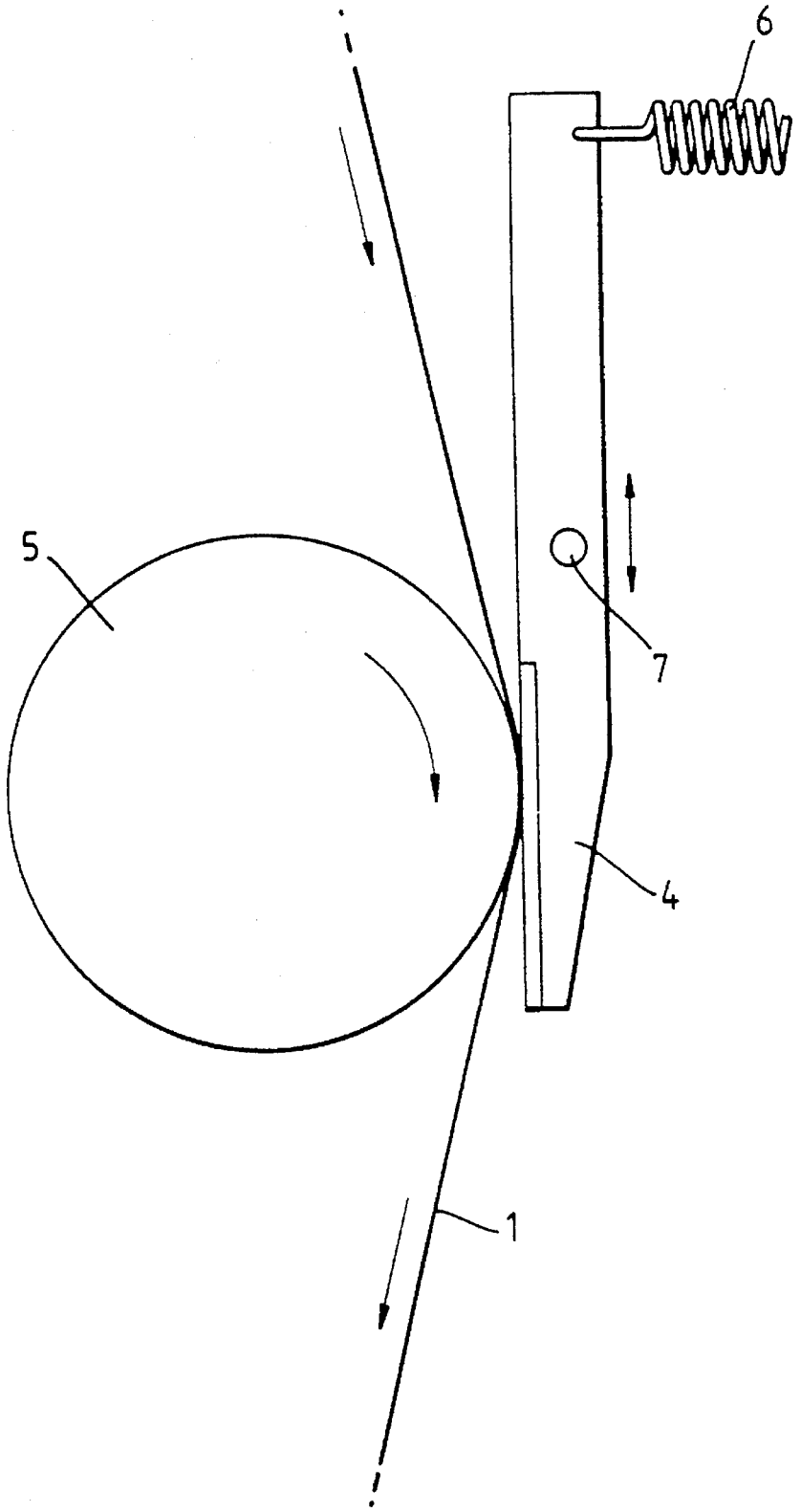
FIG. 2 is a side schematic view of the combination of a backing roller and an array of sharp blades for forming surface modulations on a magnetic film in conformance with the method of the invention.

As shown in FIG. 2, each blade (4) is held in contact with the film (1) as the film moves past underneath it. The film is pressed against a smooth backing roller (5) made of stainless steel or similar material. The backing roller and other transporter rollers are driven to carry the film under the blade assembly.

The blade is held in controllable pressure against the film (1) by a spring (6) under controlled tension acting about a pivot (7). In order to improve the lifetime of the blade, it is moved up and down slowly in an oscillatory manner so that different parts of the blade surface are brought to bear on the contact point. We have found that a blade contact force of about 200 g is sufficient to cause scratches in the metal film but not to cut through the supporting polymer film.

Figure 3:
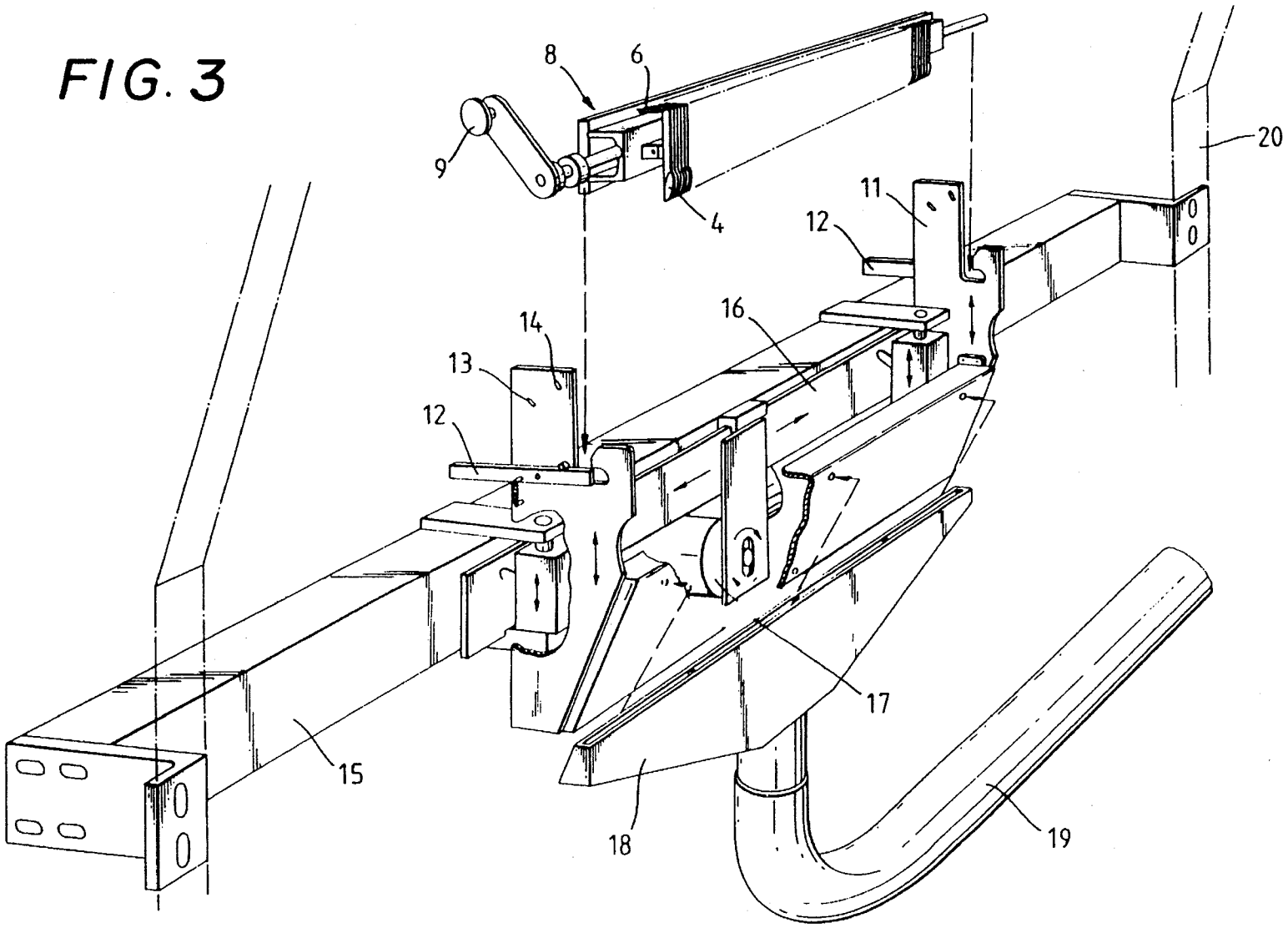
FIG. 3 is a perspective view of an apparatus for implementing the method of the invention.

The whole blade assembly holder is shown in FIG. 3 as it bolts on to the roll transport machine (20) with backing roller (neither shown). The assembly of blades (4) is mounted on carriage (8) which slots into an oscillatory holder mounted on a sliding cam plate (16) on a mounting beam (15). Once in place, the blade assembly may be lifted from the film surface by moving the blade retract levers from the scratch position locator (13) to the retract position locator (14). The oscillatory motion is driven by the motor (17), and the vacuum ducting (18) connected to the vacuum pipe (19) removes any small quantities of scratched material which build up on the blade edges during prolonged operation. The film is driven under the blade assembly at a speed of approximately 1 meter per second.

Figure 4:
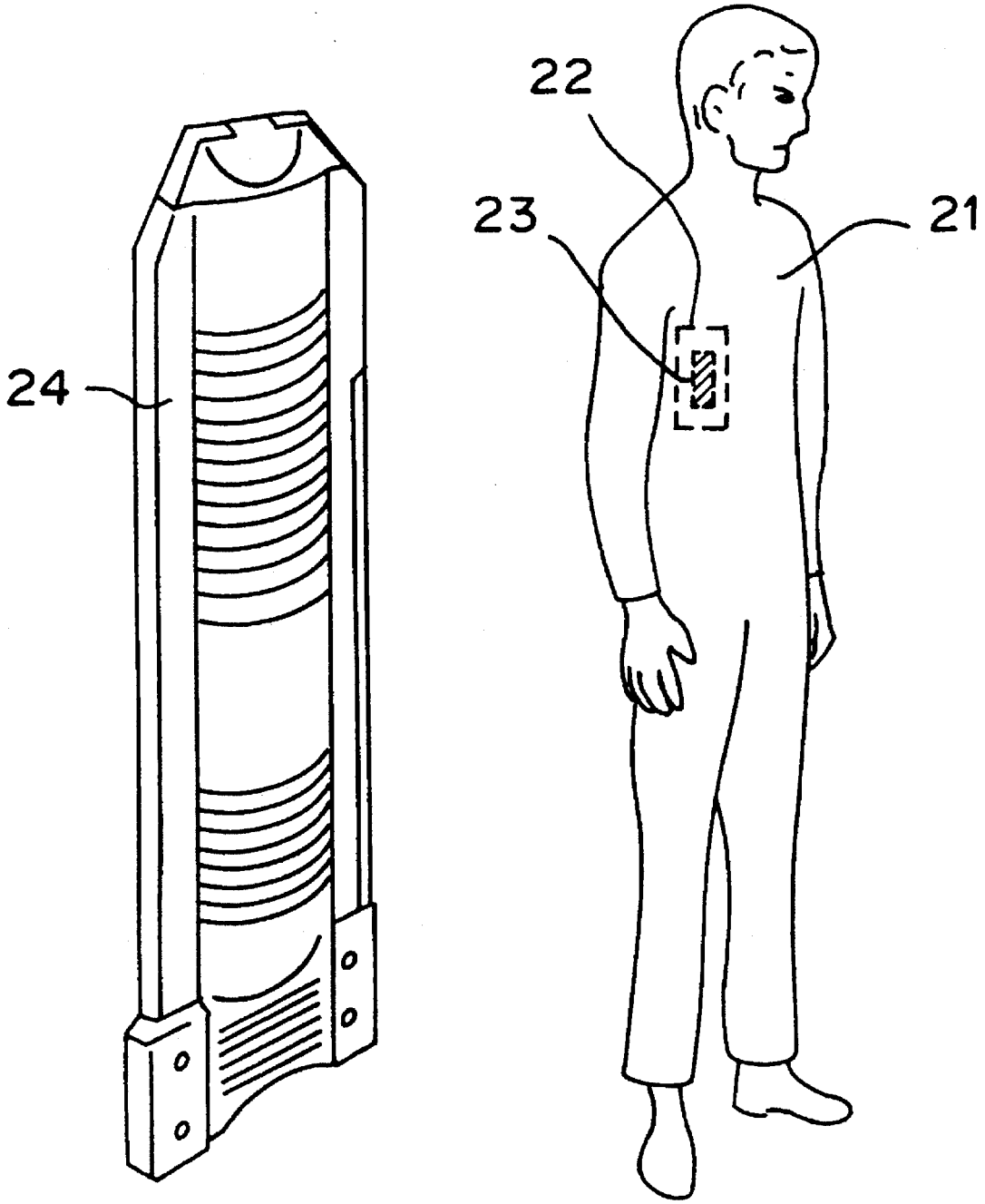
FIG. 4 is a perspective view of the application of the modified thin film of the invention.

The anti-pilferage application of the modified thin film (1) is shown in FIG. 4. In this drawing, a person (21) carries an article (22) which acts as a substrate for a tag or marker (23) made from the modified thin film (1) of the invention. The presence or absence of the tag or marker (23) is detected by an article location system (24).

We claim:

1. A method of enhancing a signal generated by the excitation of a thin film of a magnetically active material exposed to a high frequency fluctuating magnetic field, which comprises forming surface modulations on said material for (a) partitioning the material into regions having mutual magnetic independence;

(b) changing the effective magnetic permeability of the material without substantially effecting its total saturation magnetization, and (c) reducing the coercive force of the material required for high-frequency excitation of said material.

2. A method according to claim 1, wherein said material is a high-permeability, low-coercivity magnetically active material.

3. A method according to claim 1, wherein said thin film of magnetically active material is supported on a substrate.

4. A method according to claim 1, wherein said surface modulations are formed by a technique involving the removal of material from the film.

5. A method according to claim 4, wherein said technique comprises the application of a blade or sharpened point to the surface of said material.

6. A method according to claim 4, wherein said technique comprises removal of material by chemical means.

7. A method according to claim 4, wherein said technique comprises cutting, scribing, perforation or scratching.

8. A method according to claim 4, wherein less than 25% of said magnetically active material is removed.

9. A method according to claim 8, wherein less than 5% of said magnetically active material is removed.

10. A method according to claim 9, wherein less than 1% of said magnetically active material is removed.

11. A method according to claim 10, wherein more than 0.1% and less than 1% of said magnetically active material is removed.

12. A method according to claim 1, wherein said surface modulations are formed by a technique which does not remove material from the thin film.

13. A method according to claim 12, wherein said technique causes localised plastic deformation of the magnetically active material.

14. A method according to claim 13, wherein said technique comprises stamping, cracking or folding the thin film.

15. A method according to claim 1, wherein said surface modulations are formed by means of impregnation or localised heating.

16. A method according to claim 15, wherein said surface modulations are formed by applying focused electromagnetic radiation, laser radiation, ion beams, beam of neutral particles, jets of solid particles or jets of liquids to said material.

17. A method according to claim 1, wherein said surface modulations are formed by means of localised application of further quantities of said material onto said film.

18. A method according to claim 1, wherein said modulations are formed by means of localized application of a further material onto said film, which further material is magnetically different from said magnetically active material.

19. A marker or tag for use in an anti-pilferage or article location system, comprising a magnetically active material consisting of a thin film of a single material supported on a substrate, said thin film of magnetically active material having surface modulation means for:

(a) partitioning said material into regions having mutual magnetic independence;

(b) changing the effective magnetic permeability of the material with substantially no effect on its total saturation magnetization; and (c) reducing the coercive force of the material required for high-frequency excitation of said material.

20. An anti-pilferage or article location marker as claimed in claim 19, wherein said surface modulation means includes perforations or security cuts.

* * * * *